US005569526A

United States Patent [19]

Tettamanti et al.

[11] Patent Number: 5,569,526

[45] Date of Patent: Oct. 29, 1996

[54] ANODE STRUCTURE FOR CATHODIC PROTECTION OF STEEL-REINFORCED CONCRETE AND RELEVANT METHOD OF USE

[75] Inventors: Michele Tettamanti, Como; Marcello Biagioli, Milan, both of Italy

[73] Assignee: Oronzio De Nora S.A., Italy

[21] Appl. No.: 294,624

[22] Filed: Aug. 23, 1994

Related U.S. Application Data

[63] Continuation of Ser. No. 928,874, Aug. 11, 1992, abandoned.

[30] Foreign Application Priority Data

Sep. 23, 1991 [IT] Italy ..... MI91A2527
Feb. 11, 1992 [IT] Italy ..... MI92A0271

[51] Int. Cl.[6] ..... B32B 5/16

[52] U.S. Cl. ..... 428/225; 428/228; 428/392; 428/908.8; 204/284; 204/290 F; 204/196; 106/713

[58] Field of Search ..... 427/126.1, 147; 428/225, 228, 392, 908.8; 204/80, 147, 284, 290 F; 106/713

[56] References Cited

U.S. PATENT DOCUMENTS 4,900,410 2/1990 Bennett et al. ..... 204/147
5,062,934 11/1991 Mussinellil ..... 204/147
5,098,543 3/1992 Bennett et al. ..... 204/196
5,200,259 4/1993 Bartholomew ..... 428/224

FOREIGN PATENT DOCUMENTS 0147977 10/1985 European Pat. Off. .

*Primary Examiner*—Patrick J. Ryan
*Assistant Examiner*—Cathy Lam
*Attorney, Agent, or Firm*—Bierman and Muserlian

[57] ABSTRACT

The present invention relates to a method for cathodic protection of steel reinforced concrete which comprises using an anode structure made of an array of valve metal strips activated by an electrocatalytic coating and having voids therein, supported by or inserted into insulating spacers, said strips being connected by connection means either provided with voids or without voids, or rods, bars, insulated cables. The anode structure is applied to the reinforcing steel cage during Construction before the concrete is poured. The anode structure of the present invention exhibits a remarkable mechanical resistance and has an anode surface which may be tailored in order to provide for the necessary protection current on the basis of the density of the reinforcing bars contained in the structure to be cathodically protected.

16 Claims, 4 Drawing Sheets

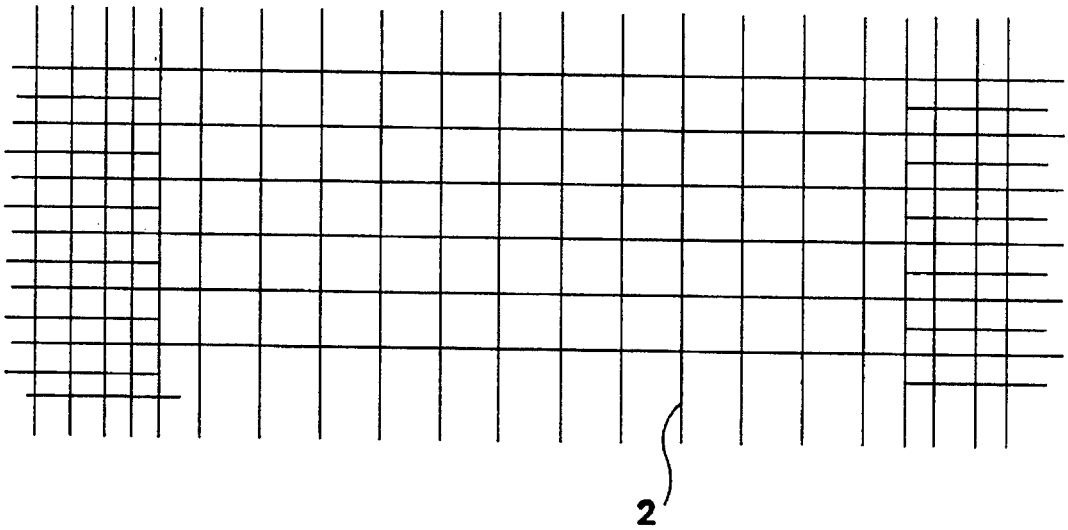
FIG. IA
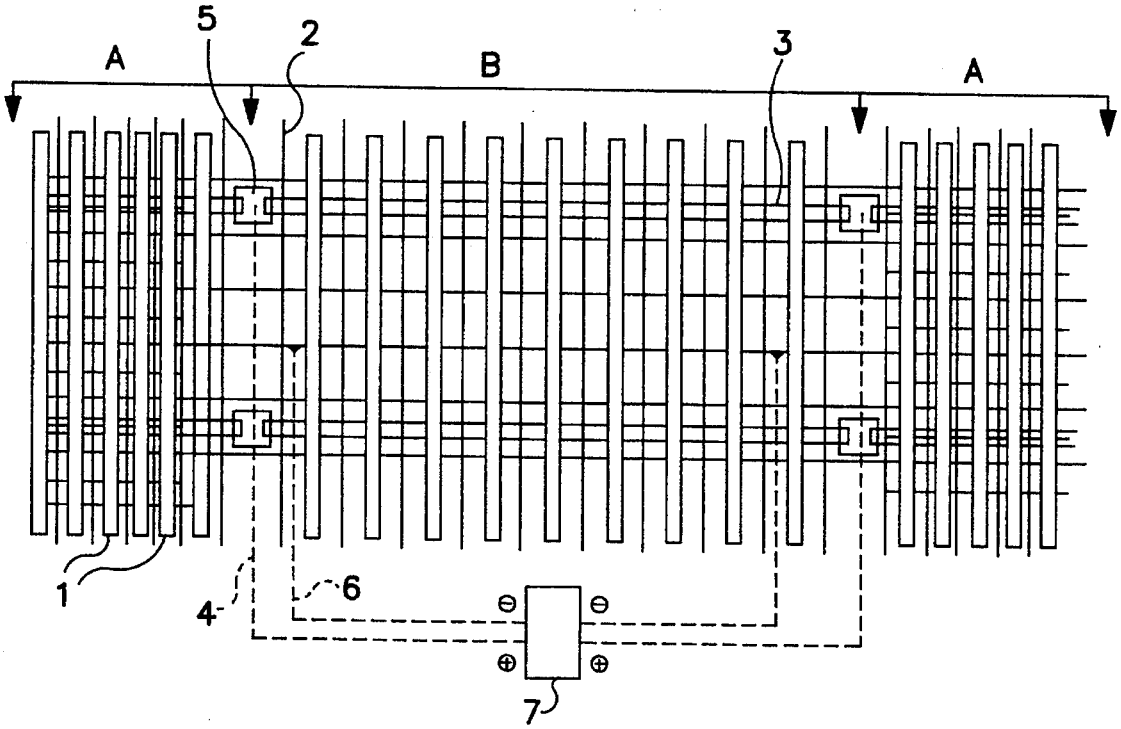
FIG. IB

ANODE STRUCTURE FOR CATHODIC PROTECTION OF STEEL-REINFORCED CONCRETE AND RELEVANT METHOD OF USE

PRIOR APPLICATION

This application is a continuation of U.S. patent application Ser. No. 928,874 filed Aug. 11, 1992, now abandoned.

BACKGROUND OF THE INVENTION

Cathodic protection of metal structures is well known. Substantially the metal structure is made the cathode in a circuit including a direct current source, an anode and an electrolyte between the anode and the cathode. The exposed surface of the anode is made of a material which is resistant to corrosion, for example platinum or mixed metal oxides, on a base structure made of a valve metal such as titanium or an organic polymer containing a dispersion of carbon black or graphite. There are many types of metal structures which need protection from corrosion, including steel reinforcing members in concrete, which are often referred to as "rebars". Concrete is sufficiently porous to allow passage of oxygen and liquid through it. Consequently, salt solutions, which remain in the concrete or which permeate the concrete from the outside, will cause corrosion of the rebars in the concrete. This is especially true when the electrolyte contains chloride ions, as for example in structures which are contacted by the sea water, and also in bridges, parking garages, etc. which are exposed to water containing salt used for deicing purposes or, finally, when calcium chloride has been added to the mortar as a hydration accelerator. The corrosion products of the rebars occupy a much larger volume than the metal consumed by the corrosion. As a result, the corrosion process not only weakens the rebars, but also, and more importantly, causes cracks and spalls in the concrete. It is only within the last ten or fifteen years that it has been appreciated that corrosion of rebars in concrete poses problems of the most serious kind, in terms not only of cost but also of safety. There are already many reinforced concrete structures which are unsafe or unusable because of deterioration of the concrete as a result of corrosion of the rebars, and unless some practical countermeasures to the problem are applied the number of such structures will increase dramatically over the next decade. Consequently, much efforts and expenses have been devoted to the development of methods for cathodic protection of rebars in concrete. As a result, cathodic protection has been recently proposed for the prevention against corrosion at the stage of the construction of concrete structures which are expected to be contaminated by chlorides during their lifetime ( for example bridges in mountain areas, docks, structures operating in sea environments). Cathodic protection, applied to already built new structures, comprises several steps which are time and labor consuming. In fact, it comprises making slots in the concrete to expose the rebars, installing connection cables, sandblasting the concrete surface, positioning the anodes and covering the same by a cementious overlay. If installation is carried out during the construction phase before pouring of the concrete, there would be no need for these preparation with obvious remarkable savings. The anode for cathodic protection of new structures, which should be installed on the reinforcing steel cage before concrete pouring, needs to be kept apart with appropriate insulating means and should also exhibit outstanding mechanical characteristics to avoid possible ruptures during pouring of the cement or sagging due to the weight of the concrete. In this event the anode would come into contact with the metal of the reinforcing bars causing shortcircuiting of the system. The structures of the prior art anodes are not suitable for installation as above illustrated. For example, British patent no. 2,175,609 describes an extended area anode comprising a plurality of wires in the form of an open mesh provided with an anodically active coating which may be used for the cathodic protection of steel rebars in reinforced concrete structures.

U.S. Pat. No. 4,708,888 describes a cathodic protection system using anodes having a highly expanded structure with more than 90% of void areas with respect to the empty areas.

The anode systems described in the cited patents cannot be utilized during construction before pouring of the concrete because the flimsiness of the highly expanded titanium meshes would easily result in mechanical damage and possible shortcircuit with the rebar cage during the pouring operation and subsequent vibration of the concrete.

OBJECTS OF THE INVENTION

It is an object of the present invention to overcome the shortcomings of prior art by providing for an improved anode structure having enhanced mechanical properties and comprising metal strips supported by spacers which can be applied to the reinforcing steel structure during construction, before the step where concrete is poured.

It is another object of the present invention to supply for an improved anode structure having a suitable geometry to be adjusted so that the current distribution conforms to the density of rebars in the structures to be cathodically protected.

It is a further object of the present invention to provide for a method for forming the anode structure of the invention onto the last layer of the reinforcing rebars or inside the reinforcing steel cage before pouring the concrete during the construction of the structure to be cathodically protected.

DESCRIPTION OF THE INVENTION

The anode structure of the present invention is made of an array of anode elements mechanically connected by suitable means and supported by spacers. Such connection means may have various geometries, such as metal strips with or without voids, bars, rods, insulated metal cables. Said anode elements have elongated shapes, having also various geometries, such as rods, wires, plates. However, the most preferred shape is strips of valve metals, having voids and provided with an electrocatalytic coating. The voids on the strips may be punched on the metal but most economically an expanded metal is used. These voids provide for the best contact between the anode surface and the concrete which penetrates the voids during pouring.

The valve metal of the strips is titanium, tantalum, zirconium, and niobium. Titanium is best preferred in view of its mechanical resistance, corrosion resistance and availability and cost. As an alternative valve metal alloys or intermetallic compounds may be used. Activation, that is the step of providing said electrocatalytic coating, is carried out according to the procedures well known in the art, either on the punched or expanded metal before cutting into strips or alternatively on the strips after cutting from the punched or expanded metal sheet. Bending of the strips, as discussed below, may be carried out before or after activation.

Preferred activation is provided by electrocatalytic coatings based on mixed oxides of valve metals and platinum group metals, such as titanium, tantalum, iridium and ruthenium or mixtures of the same. Another suitable coating is a cobalt spinel or a coating comprising an intermediate layer of platinum and iridium metals or a mixed oxide of titanium and tantalum under the electrocatalytic surface coating. Provided that certain titanium alloys containing small amounts of catalytic metals such as ruthenium or palladium are used, the activation step may be avoided. The strips width is over 3 mm and the thickness is in the range of 0.25 mm to 5 mm, preferably between 0.5 and 3 min.

The spacers, directed to avoid any risk of short-circuit between the anode strips and the reinforcing steel may be prefabricated elements made of plastic or cementitious material having a high mechanical resistance, to ensure easy handling and transport, as well as adequate stiffness once installed on the metal structure to be protected. Typically the spacers may have a square, rectangular, circular, elliptic or triangular cross-section. The spacers may have a diameter from 2 to 10 cm or cross-section dimensions of 2 to 10 cm. The most general practice comprises applying said spacers to the metal cage to be protected so that they are mechanically secured and firmly held in position. Thereafter the anode strips are fixed to said spacers. For example, they are inserted in a slot suitably provided in the spacers. Alternatively the strips are applied onto the spacers either by fastening by means of plastic or metallic nails, screws, clips, e. g. titanium clips, hooks or staples or by adhesion by means of glues, epoxy adhesives or the like.

In an embodiment of the present invention the anode strips are first applied to said spacers as above described and then the strip-spacer assemblies are positioned on the last layer of the reinforcing metal cage before pouring the concrete.

In a further embodiment of the present invention the anode strips may be curved in the widthways dimension for all the length of the strip so to obtain the maximum rigidity and mechanical resistance to the thrust of the poured concrete and to the lateral pressure exerted by the concrete which distributes inside the reinforcing cage. The direction of the curve may be either towards the inside as towards the outside with respect to the spacer surface. Other types of bending may be also resorted to as a multiple ply to offer a higher mechanical resistance or bending of the strip may be such as to bring the two edges of the strip together and fixing the same by spot-welding, thus forming a cylinder. p Any angle of bending may also be used so that the strips may be bent to form a geometrically square, rectangular, triangular cross-section.

In another embodiment the strips may be interposed between two spacers, forming a sandwich structure. The anode strips, which have a distance from each other higher than their width, will not cause obstruction to the concrete flow during pouring as compared to the use of the expanded meshes and relevant support, as taught by the prior art.

Uniform and optimum distribution of current on the reinforcing metal structure is attained according to the present invention by suitably varying the dimensions and expansion degree of the strips, as well as the the distance with each other.

The strips are connected together by means of connection elements welded thereto or simply mechanically attached by cold-heading, preferably forming 90° angles, other angles being also acceptable. As explained before, said means of connection may be manufactured by using the same material as the strips as well as different materials, such as insulated copper wires or strands. In this latter case electrical connection is preferably carried out either by means of a pull box or by plastic deformation of the cable on the strips.

The cathodic protection system according to the present invention comprises applying electric current to the anode structure made of the strips spaced apart and connected by means of connection elements. Current distribution and therefore optimum cathodic protection is obtained by the arrangement of the present invention which may be specifically tailored on the density of reinforcing bars per unit area of concrete. For example in highway bridges the density of reinforcing bars is higher in the slabs areas corresponding to the piers than in the middle section to guarantee the optimum structural resistance. The corresponding ratio between square meters of reinforcing steel and square meters of concrete surface is indicatively 5 and 1. Such substantial variation of said ratio is by no means a problem with the anode structure of the present invention. In fact, as the strips are applied before pouring the concrete, their void area, number, dimensions and spacing apart may be suitably tailored depending on said density of reinforcing bars in order to obtain the best current distribution and thus the most efficient cathodic protection of the reinforcing bars avoiding an excessive protection in some areas and underprotection in others. The need of homogeneously distributing current is of the outmost importance as steel will undergo corrosion when unprotected, that is fed with a current density having a value lower than the optimum one. On the contrary, overprotection will cause hydrogen embrittlement, especially if the steel to be protected is characterized by a high fatigue limit as for that used in the case of prestressed or post-tensioned reinforced concrete structures. The invention will now be illustrated in detail by making reference to the figures, wherein:

BRIEF DESCRIPTION OF THE DRAWINGS

FIG. 1A is a cross-section taken across line A—A of FIG. 1B.

FIG. 1B is a plane view of the anode assembly of the invention.

With reference to FIG. 1, the anode strips 1) are applied onto the cage 2) of reinforcing bars by means of spacers not shown in the figure. The connection elements 3 ) provide for the electrical continuity between the strips. The cathodic protection system is completed by a direct current source 7) and by main feed cables 4 which connect the positive pole of said source to said connection means thanks to the junction boxes 5) and main feed cables 6) which connect the negative pole of said source to the reinforcing barscage 2 ). The spacing among the strips is lower in area A in correspondence of the higher density of reinforcing bars and higher in area B where the density is lower.

In FIG. 2, the anode strips 1), after bending to increase the overall stiffness, are applied onto the reinforcing bars cage 2, in a parallel direction with respect to the plane defined by the more external layer of the cage. Said strips are insulated from the reinforcing bars by means of spacers 3). The concrete 4) is poured on the structure following the direction indicated by the arrows. Said spacers 3) are in the form of elongated flat bars, made either of plastics or cementitious material having protruding rims which increase the overall stiffness and also allow an easy positioning of said bent strips 1). Said strips are firmly held into position by means of suitable fasteners not shown in the figure, such as nails, screws, clips, made either in plastic material or metal. In this latter case a valve metal, and especially titanium, is highly preferred. Both procedures of assembling may be practiced, the first one comprising installing said spacers 3) on the reinforcing bars cage 2) and then positioning and fastening the activated strips 1) onto such spacers, the second one comprising first assembling said strips 1) onto said spacers 3) by means of said fasteners and then installing the strip-spacer assembly onto said reinforcing bar cage 2 ).

FIG. 3 shows an alternative embodiment of the present invention, wherein activated fiat Strips 1) are applied onto the reinforcing bars cage 2) in a perpendicular position with respect to the plane defined by the more external layer of the cage. Spacers 3), made of plastic or cementitious material, are in the form of elongated bars or pins having a slot therein where the activated strips 1) are positioned.

FIG. 4 shows a further embodiment of the present invention wherein activated flat strips 1) are just superimposed to fiat spacers 3) made of plastic or cementitious material having the form of elongated bars with a rectangular section.

FIG. 5 gives a better understanding of how the activated strips 1) may be fastened to spacers 3) by means of nails or pins 5, made of plastics or metal.

Figure 2:
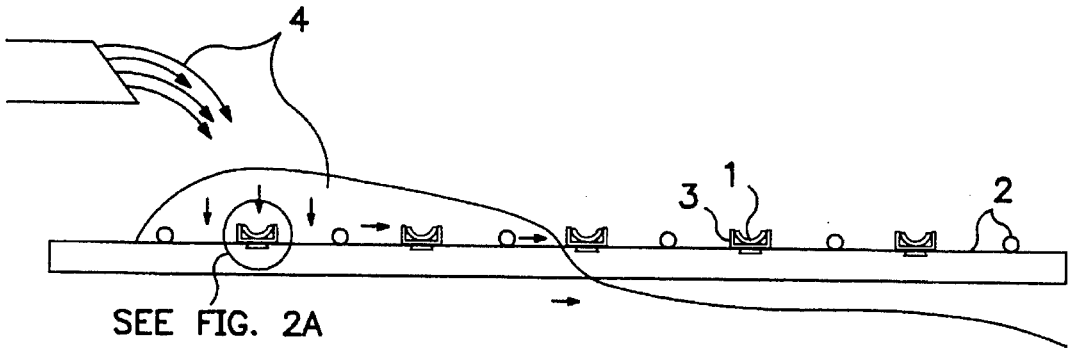
FIG. 2 is a cross-section of a different embodiment of the invention and FIG. 2A is an enlarged partial view of the portion of FIG. 2 encircled.
Figure 2A:
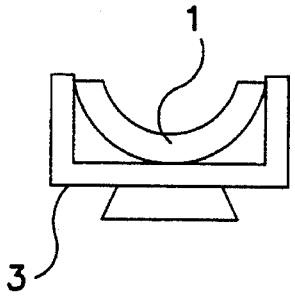
Figure 3:
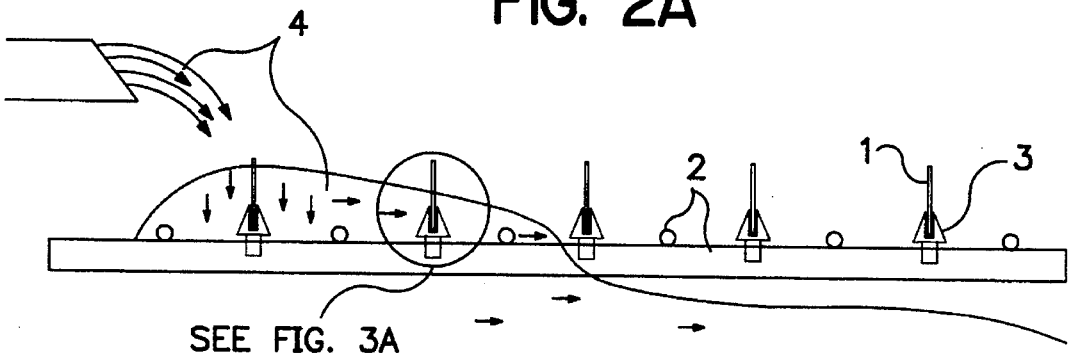
FIGS. 3 and 4 are cross-sections of different embodiments of the invention and FIGS. 3A and 4A are an enlarged view of the part of FIGS. 3 and 4, respectively encircled.
Figure 3A:
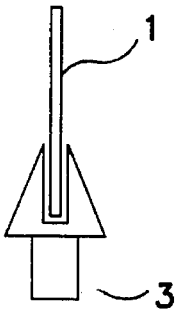
Figure 4:
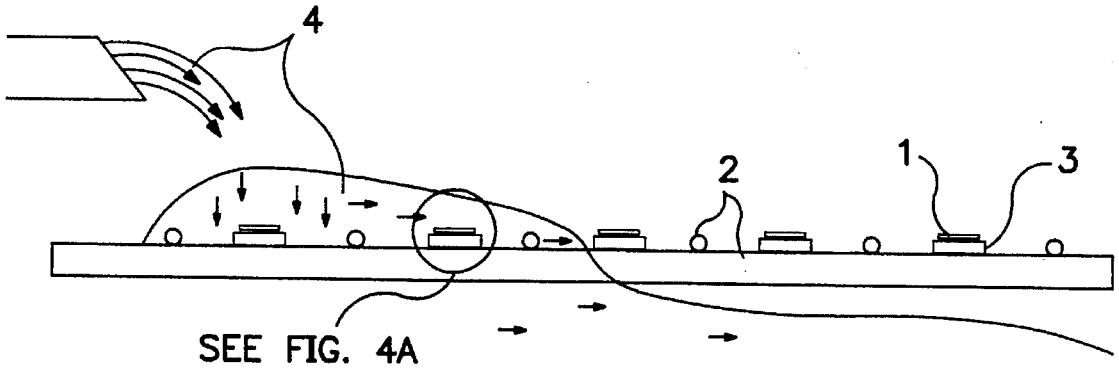
Figure 4A:
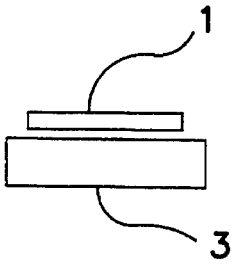
Figure 5A:
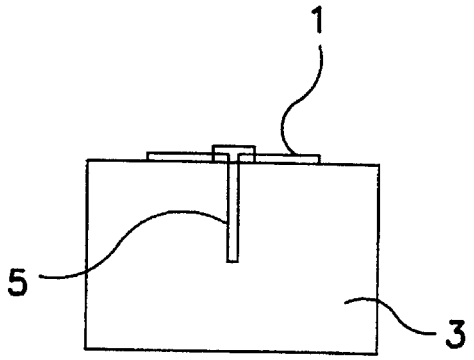
FIGS. 5B and 5D are cross-sections of different embodiments of the invention and FIGS. 5A and 5C are cross-sections through 5B and 5D, respectively.
Figure 5C:
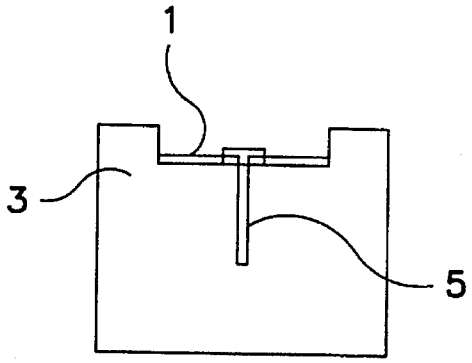
Figure 5B:
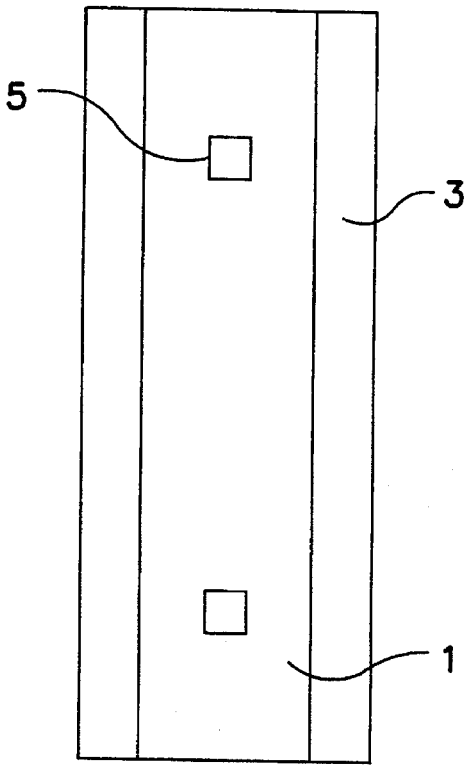
Figure 5D:
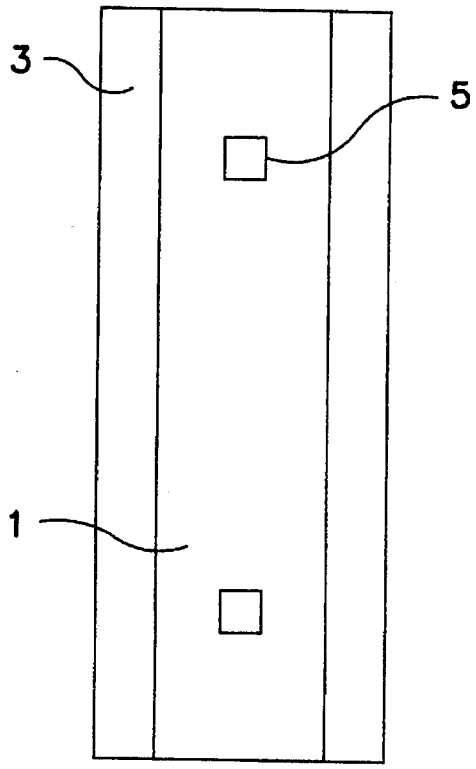

We claim:

1. An anode for cathodic protection of a steel reinforcing cage of concrete structures to be applied to said cage before concrete is cast around, said anode comprising a plurality of valve metal or valve metal alloy elongated elements connected together by connectors, characterized in that each of said elongated elements is fixed to a stiff elongated spacer, said spacers in turn are fixed to said steel reinforcing cage to provide the anode with both electrical insulation with respect to said cage and mechanical resistance during casting of the concrete.

2. The anode of claim 1 wherein said spacers are made of cementitious material.

3. The anode of claim 1 wherein said spacers are made of plastic.

4. The anode of claim 1 wherein said spacers have a rectangular, polyhedral or circular cross-section.

5. The anode of claim 1 wherein said elongated elements are strips, wires or rods.

6. The anode of claim 5 wherein said strips have voids.

7. The anode of claim 6 wherein said strips with voids are cut from expanded metal sheets.

8. The anode of claim 5 wherein said strips have a width larger than 3 mm.

9. The anode of claim 5 wherein said strips have at least one longitudinal bending.

10. The anode of claim 5 wherein said strips are bent to form a cylinder.

11. The anode of claim 1 wherein said elongated elements are provided with an electrocatalytic coating.

12. The anode of claim 1 wherein said connectors are valve metal or valve metal alloy strips.

13. The anode of claim 1 wherein said elongated spacers are positioned in a substantially parallel array.

14. The anode of claim 13 wherein said elongated elements and spacers have dimensions and spacing directed to maintain uniform cathodic protection through said reinforcing steel cage.

15. A method of assembling the anode of claim 1 comprising the following steps:

a) fixing the elongated stiff spacers on the reinforcing steel cage, b) fixing each one of the elongated elements of the anode on one of the said stiff spacers and c) connecting said elongated elements together by connectors.

16. A steel reinforced concrete structure wherein the reinforcing cage is provided with the anode of claim 1.

* * * * *